United States Patent [19]

Trabitzsch et al.

[11] Patent Number: 4,581,153

[45] Date of Patent: Apr. 8, 1986

[54] WASHING AND CLEANING AGENTS

[75] Inventors: Uwe Trabitzsch, Ratingen; Helmut Gründ, Haan, both of Fed. Rep. of Germany

[73] Assignee: Henkel Kommanditgesellschaft auf Aktien, Duesseldorf, Fed. Rep. of Germany

[21] Appl. No.: 571,026

[22] Filed: Jan. 16, 1984

[30] Foreign Application Priority Data

Jan. 19, 1983 [DE] Fed. Rep. of Germany ..... 3301577

[51] Int. Cl.[4] ..... C11D 3/12; C11D 7/10

[52] U.S. Cl. ..... 252/140; 252/174.17; 252/174.25; 252/173; 252/179; 252/DIG. 14

[58] Field of Search ..... 252/131, 140, 154, 155, 252/174, 173, 174.17, 174.25, 179, 159, 160, DIG. 1; 424/49, 69

[56] References Cited

U.S. PATENT DOCUMENTS

| | | | |
|---|---|---|---|
| 2,882,243 | 4/1959 | Milton | 252/455 |
| 2,882,244 | 4/1959 | Milton | 252/455 |
| 4,083,793 | 4/1978 | Jakobi et al. | 252/99 |
| 4,169,075 | 9/1979 | Kuhling et al. | 252/558 |
| 4,215,004 | 7/1980 | Borgerding et al. | 252/156 |
| 4,362,715 | 12/1982 | Strianse et al. | 424/69 |
| 4,383,987 | 5/1983 | Kiozpeolou | 424/49 |
| 4,414,130 | 11/1983 | Cheng | 252/140 |

FOREIGN PATENT DOCUMENTS

| | | |
|---|---|---|
| 0050897 | 10/1981 | European Pat. Off. . |
| 0079641 | 5/1983 | European Pat. Off. . |
| 2736903 | 2/1978 | Fed. Rep. of Germany . |
| 3006333 | 9/1980 | Fed. Rep. of Germany . |
| WO83/03621 | 10/1983 | PCT Int'l Appl. . |

*Primary Examiner*—Paul Lieberman
*Assistant Examiner*—John F. McNally
*Attorney, Agent, or Firm*—Ernest G. Szoke; Henry E. Millson, Jr.; Mark A. Greenfield

[57] ABSTRACT

Powder-form washing and cleaning agents which can be made up into stock liquors containing in addition to synthetic surfactants and ingredients such as alkali carbonates, alkali silicates, alkali sulfates, water-soluble, organic or inorganic complexing agents, (a) from 10 to 40% by weight of finely particulate zeolites of the NaA or NaX type or mixtures thereof and (b) from 0.5 to 2.5% by weight of xanthan gum as dispersant in a ratio by weight of a:b of from 5:1 to 25:1 for the preparation of approximately 10% by weight aqueous stable stock liquor suspensions.

20 Claims, No Drawings

WASHING AND CLEANING AGENTS

BACKGROUND OF THE INVENTION

In industry and in hospitals, so-called general detergents make up a high percentage of total detergent consumption. Apart from bleach, general detergents contain all the ingredients necessary for optimal washing, namely surfactants, soda, silicates, triphosphates and also redeposition inhibitors, optical brighteners and others. In practice, the bleach (perborate or chlorine bleaching liquor), which is missing from this list, is separately introduced into the washing process as required. Depending on the size of the factory and on the type of washing machine, general detergents are either directly introduced into the washing process in powder form through a metering system or are first made up into so-called stock liquors and subsequently introduced into the washing process in the form of a solution. Today, the preparation of stock liquors is standard practice in large-scale operations where washing is carried out in laundries and automatic metering is virtually essential. The use of stock liquors makes the washing process much more efficient, but also presupposes considerable investment which is not practical for every factory for reasons of cost and space.

Stock liquors are understood to be aqueous solutions of the detergent powder in a concentration of normally from 5 to 15% by weight and generally of the order of 10% by weight. Stock liquors are prepared in stock liquor containers having dimensions adequate to accommodate enough stock liquor for use once or twice a day. The containers are normally able to hold from 0.5 to 2 cubic meters. A typical machine for preparing stock liquors includes a stirrer, an indirect steam-operated heating system and a pump which delivers the prepared stock liquor to the washing machine. The preparation of a 10% stock liquor is generally carried out as follows:

1. Approximately 200 liters of softened water are introduced into a vessel with a capacity of 1 cubic meter of liquid.
2. The stirrer and heating system are switched on and the heating thermostat is set at approximately 40° C.
3. 100 kg of general detergent (for example 4×25 kg bags) are then rapidly introduced into the vessel with the water tap and stirrer on.
4. The water tap is turned off when the 1000 liter mark is reached.
5. The stirrer is kept on for about another 20 minutes, during which the temperature of the solution is generally increased to 60° C. The stock liquor is then ready for use and may be introduced into the washing process by means of a metering pump.

The particular demand for stock liquor is regulated through the automatically controlled washing program. The satisfactory operation of a stock liquor system of the type in question presupposes inter alia that the detergent ingredients are either completely dissolved in the solution or at least are kept finely suspended therein. Both the sedimentation of and the creaming up caused by water-insoluble constituents endanger the automatic metering system because any resulting blockage in the pipe system of the machine in which the stock liquor is prepared can give rise to considerable problems in the washing process as a whole.

In general, detergents containing small quantities of water-insoluble, very finely particulate magnesium silicate can also be made up into stock liquors. Such small quantities have clearly not been a problem since faults attributable thereto have been the exception and hence the powder-form detergents used in their make-up can be safely employed.

However, phosphates in detergents are now being blamed to an increasing extent both by experts and by the public for the eutrophication of waters and, because of this, their presence is regarded as a disadvantage. Accordingly, several substances have been proposed as substitutes for the phosphates hitherto commonly used in detergents. The most successful and widely used have clearly been sodium aluminium silicates in the form of synthetic zeolites of the NaA and NaX types, such as are described, for example, in U.S. Pat. Nos. 2,882,243 and 2,882,244.

Powder-form detergents containing phosphate substitutes of this type became known for the first time in 1974 and were described in U.S. Pat. Nos. 4,083,793 and 4,148,603. Due to the increasing importance of zeolites, the need arose to try to introduce them into detergents to be made up into stock liquors. Due to their tendency towards sedimentation, however, their use in general detergents that can be made up into stock solutions would only appear to be possible in the present state of the art under the following conditions:

1. continuous stirring of the stock liquor,
2. special pumps (for example piston displacement pumps) for pumping the stock liquor,
3. special construction of the pipe system between the stock liquor container and the washing machine to prevent the insoluble builder particles from sedimenting.

Unfortunately, these requirements are satisfied in only a very few factories, so that general detergents containing necessary quantities of sodium aluminium silicate for use in stock liquors has not yet been made widely available.

U.S. Pat. No. 4,215,004 describes detergent suspensions which may also contain up to 30% by weight of sodium aluminium silicate. These stabilized suspensions contain as thickener a combination of a water-dispersible cross-linked copolymer of an acrylic acid and a polyester of a polyol on the one hand and sodium polyacrylate on the other hand. These detergent suspensions are obtained by carefully stirring the individual constituents in a certain order into water. These products are thick suspensions of relatively low water content. Unfortunately, their complicated production makes them unsuitable for use in industrial laundries because the expert is accustomed to preparing the stock liquor from a stock detergent in powder form by stirring into water and not by diluting a suspension.

Storable and pumpable suspensions of sodium aluminium silicates stabilized by the addition of a dispersant are described in numerous publications, for example in U.S. Pat. Nos. 4,072,622 and 4,169,075. These stable suspensions have a very high concentration of sodium aluminium silicate. They are used for the commercial production of detergent powders containing sodium aluminium silicate and, in that respect, are preferred to the dried sodium aluminium silicate powder.

However, the above prior art does not provide the expert with any useful information as to how to solve the problem in question here. A stock liquor is a dilute aqueous solution or suspension of a detergent, so that the known teachings on the preparation of concentrated suspensions could not readily be applied to the preparation of dilute suspensions. In fact, none of the stabilizers described for concentrated sodium aluminium silicate suspensions has proved suitable for stabilizing a stock liquor containing sodium aluminium silicate.

DESCRIPTION OF THE INVENTION

Accordingly, it was completely surprising to find that xanthan gum proved to be a dispersant which, when added in quantities of from about 0.5 to about 2.5% by weight to powder-form heavy-duty detergents containing from about 10 to about 40% by weight of water-insoluble alkali aluminium silicate, led to general detergents which can be handled and marketed as such and which, in the same way as hitherto known tripolyphosphate-based detergents, can readily be used in stock liquor systems by conversion into approximately 10% liquors.

Accordingly, the present invention relates to powder-form, alkaline-reacting washing and cleaning agents which are capable of being made up into stock liquors and which contain synthetic surfactants, alkali aluminium silicates, and, optionally but preferably, other ingredients such as alkali carbonates, alkali silicates, alkali sulfates, water-soluble organic or inorganic complexing agents, optical brighteners and smaller quantities of other standard additives, wherein such agents contain (a) from about 10 to about 40% by weight, and preferably from about 15 to about 25% by weight of finely particulate zeolites of the NaA or NaX type or mixtures thereof and (b) from about 0.2 to about 2.5% and preferably from about 0.5 to about 2.0% by weight of xanthan gum, the ratio by weight of a:b amounting to between about 5:1 and about 25:1, and preferably to between about 10:1 and about 20:1, and can be converted by mixing with water into from about 5 to about 15%, preferably approximately 10% by weight stable suspensions.

The powder-form preparations according to the invention preferably have the following composition:

from about 2 to about 40, preferably from about 5 to about 15% by weight of a surfactant component composed of anionic and/or non-ionic surfactants;

from about 10 to about 40, preferably from about 15 to about 25% by weight of finely particulate zeolites of the NaA or NaX type or mixtures thereof;

from about 0.2 to about 2.5, preferably from about 0.5 to about 2.0% by weight of xanthan gum;

the ratio by weight of zeolite to xanthan gum amounting to between about 5:1 and about 25:1 and preferably to between about 10:1 and about 20:1;

from 0 to about 60, preferably from about 0.5 to about 50% by weight of one or more of water-soluble, organic or inorganic complexing agents, alkali carbonates, alkali silicates, alkali sulfates and also other standard ingredients of powder-form washing and cleaning agents; and balance to 100% by weight of free water, provided the free water content does not exceed about 20% of the weight of the preparation.

The present invention also relates to a dispersion aid for dry powder-form washing and cleaning agents containing (a) from about 10 to about 40, preferably from about 15 to about 25% by weight of a zeolite of the NaA or NaX type, or a mixture of such zeolites, which are to be made up into approximately 10% by weight aqueous stable stock liquor suspensions and wherein the dispersion aid consists of (b) from about 0.2 to about 2.5, preferably from about 0.5 to about 2.0% by weight of xanthan gum; wherein the ratio of (a) to (b) is from about 5:1 to about 25:1, preferably from about 10:1 to about 20:1.

The invention also relates to aqueous stable stock liquor suspensions containing from about 5 to about 15% and preferably about 10% by weight of the powder-form preparation of the invention.

Xanthan gum, as defined in Römpps Chemie-Lexikon, 7th Edition (1973), pages 1355 and 1356, is a high molecular weight polysaccharide, i.e. an exocellular heteropolysaccharide, which is produced by various Xanthomonas species, for example by *Xanthomonas campestris.* Xanthan gum is a hydrophilic colloid. Numerous patents and publications are concerned with its production by the aerobic propagation and cultivation of bacteria of the genus Xanthomonas in aqueous nutrient media. Such references include a basic patent, U.S. Pat. No. 3,000,790, and modifications of the fermentation process described, for example, in U.S. Pat. Nos. 3,020,206; 3,391,060; 3,427,226; 3,433,708; 3,271,267; 3,251,749; 3,281,329; 3,455,786; 3,565,763; 3,594,280; 3,391,061; 4,119,546; and 4,282,321.

The hydrophilic colloids produced by *Xanthomonas campestris* are polysaccharides containing mannose glucose, glucuronic acid, O-acetyl residues and acetyl-linked pyruvic acid. They are formed as an exocellular reaction product of the above bacterial species during their aerobic cultivation in aqueous nutrient solutions which, in addition to the usual growth-promoting components, contain water-soluble carbohydrate compounds in particular as the carbon source. In practice, glucose in particular is used as the source of assimilable carbon.

Products such as these are commercially available and are marketed, for example, by the Kelco Comp. of Oklahoma, under the name KELZAN ®. They are said to have the following formula:

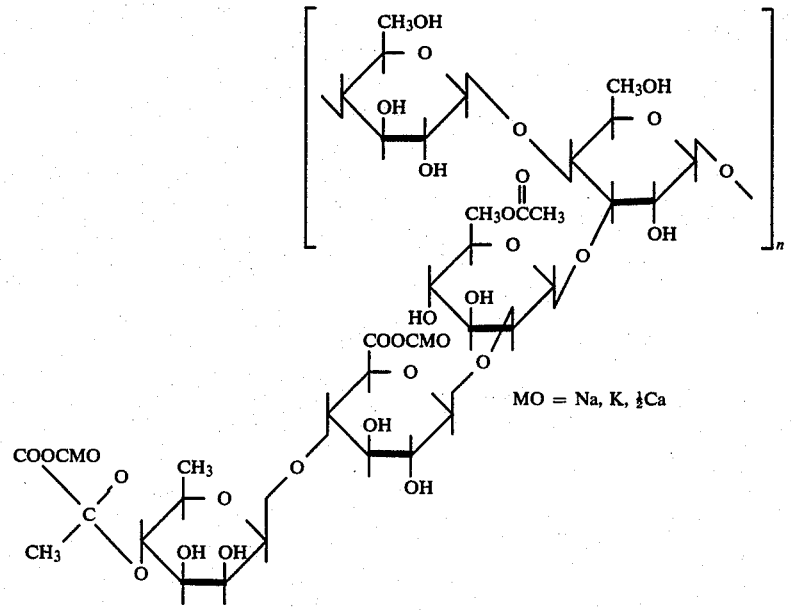

Suitable synthetic surfactants for use in the compositions of the invention include, for example, anionic surfactants of the sulfonate type, such as alkyl benzene sulfonates ($C_{8-15}$-alkyl), olefin sulfonates, i.e. mixtures of alkene and hydroxyalkane sulfonates and also disulfonates of the type obtained, for example, from $C_{12-18}$ monoolefins containing a terminal or internal double bond by sulfonation with gaseous sulfur trioixide, followed by alkaline or acidic hydrolysis of the sulfonation products. It is also possible to use the alkane sulfonates obtainable from $C_{12-18}$ alkanes by sulfochlorination or sulfoxidation, followed by hydrolysis or neutralization, or by the addition of bisulfites onto olefins, and also the esters of $\alpha$-sulfo fatty acids, for example the $\alpha$-sulfonic acids of methyl or ethyl esters of hydrogenated coconut oil, palm kernel oil or tallow fatty acids.

Suitable anionic surfactants of the sulfate type are the sulfuric acid monoesters of primary aliphatic $C_{10-20}$ alcohols (for example from coconut oil fatty alcohols, tallow fatty alcohols or oleyl alcohol) and those of secondary aliphatic $C_{10-20}$ alcohols. It is also possible to use sulfated fatty acid alkanolamides, fatty acid monoglycerides with $C_{10-20}$ fatty acids and the sulfates of primary or secondary aliphatic $C_{10-20}$ alcohols reacted with from 1 to 6 moles of ethylene oxide.

These surfactants containing anionic groups can be used in the form of their sodium, potassium and ammonium salts and also in the form of soluble salts of organic bases, such as mono-, di- or triethanolamine.

Other suitable surfactants for use in the present compositions are non-ionic surfactants, primarily the adducts—substantially soluble in water at room temperature—of from 7 to 20 moles of ethylene oxide with 1 mole of an aliphatic $C_{10-20}$ alcohol or of an alkyl phenol, a fatty amine or a fatty acid. Particularly important are the ethoxylation products of aliphatic alcohols, especially coconut oil or tallow fatty alcohols, oleyl alcohol, $C_{10-20}$ oxo alcohols and secondary aliphatic alcohols essentially containing from 12 to 18 C-atoms. In addition to these water-soluble non-ionic surfactants, however, the corresponding water-soluble or substantially water-insoluble ethoxylation products containing from 2 to 6 ethylene glycol ether residues in the molecule are also of interest providing they are used in conjunction with the water-soluble ethoxylation products. Other suitable non-ionic surfactants are fatty acid alkanolamides, such as for example the compounds coconut oil or tallow fatty acid ethanolamide and diethanolamide, oleic acid diethanolamide, etc.

Other suitable non-ionic surfactants include surface-active amine oxides which are mostly derived from tertiary amines containing one hydrophobic $C_{10-20}$ alkyl group and two shorter alkyl and/or alkylol groups each containing up to 4 C-atoms. Typical representatives are, for example, the compounds N-dodecyl-N, N-dimethyl amine oxide, N-tetradecyl-N,N-dihydroxyethyl amine oxide and N-hexadecyl-N,N-bis-(2,3-dihydroxypropyl-)amine oxide.

The water-soluble organic or inorganic complexing agents for calcium include polycarboxylic acids, hydroxycarboxylic acids, aminocarboxylic acids, carboxyalkyl ethers, polyanionic polymeric carboxylic acids, phosphonic acids and polyphosphoric acids; these compounds generally being used in the form of their water-soluble salts. Specific examples are citric acid, carboxymethyl tartronic acid, mellitic acid, polyacrylic acid, poly-$\alpha$-hydroxyacrylic acid, carboxymethyl malic acid, nitrilotriacetic acid, 1-hydroxyethane-1,1-diphosphonic acid and the alkali pyrophosphates, tripolyphosphates and also the alkali metal salts of higher polyphosphoric acids and of metaphosphoric acid.

In addition to complexing agents, other standard components of washing and cleaning agents of the present type are primarily alkaline salts, such as alkali metal silicates, particularly alkali metal metasilicates, and inorganic fillers, such as sodium carbonate or sodium sulfate. In addition, the washing and cleaning agents can contain small quantities of, for example, soil-suspending agents which suspend the soil detached from the fibers in the wash liquor and thus prevent redeposition. Suitable soil suspending agents are water-soluble, generally organic colloids, such as for example the water-soluble salts of polymeric carboxylic acids, glue, gelatin, salts of ether carboxylic acids or ether sulfonic acids of starch or cellulose, such as carboxymethyl cellulose or methyl cellulose, particularly mixtures thereof, or salts of acidic sulfuric acid esters of cellulose or starch. Water-soluble polyamides containing acid groups are also suitable for this purpose. It is also possible to use soluble starch preparations and other starch products than those mentioned above, such as for example degraded starch, aldehyde starches, etc. Polyvinyl pyrrolidone can also be used.

Corrosion inhibitors, foam regulators, fragrances and dyes are also included among the other standard constituents of the washing and cleaning agents of the invention.

The following examples illustrate the invention without intending to limit it in any way.

EXAMPLES

The constituents of the powder-form general detergents were mixed in a Loedige mixer. Xanthan gum and fragrances were the last ingredients to be added. However, the water- and temperature-stable constituents can also be made into a so-called slurry and sprayed in the form of a mixture. The powder obtained is then also mixed with xanthan gum and fragrances. In addition to the starting formulation free from xanthan gum, the following Tables show 15 examples of washing and cleaning agents according to the invention which led to powder-form general detergents capable of being made up into stock liquors.

For the tests, which were carried out under simulated commercial use conditions, 50 g of the detergents were stirred into 500 ml of softened water and heated first to 40° C. and then to 60° C., although heating in stages is not necessary for these test formulations. Stirring was then continued for 30 minutes at 60° C. at a speed of 500 r.p.m. After 1 hour, during which it also cooled down, the stock liquor was visually examined for creaming and sediment. A second identical examination was made after 24 hours.

In the Tables, "EO" stands for ethylene oxide while "8EO" stands for the adduct of 8 moles of ethylene oxide with the immediately preceding compound. Kelzan ®, a product of the Kelco Comp., was used as the xanthan gum.

The sodium aluminium silicate used was SASIL ®, a product of Henkel KGaA, i.e. a zeolite of the NaA type having the following characteristics:

Composition: $1.04Na_2O.1Al_2O_3.2.05SiO_2$, water content 21.2%

Structure: NaA, highly crystalline, cubic with rounded corners and edges

Particle size: (Coulter Counter, volume distribution): average particle size 4.8 microns; 100% of the particles <15 microns;

Calcium binding power at 22° C.: 170 mg CaO/g.

A finely particulate zeolite of the NaA type produced by industrial processes can contain small quantities of zeolite of the NaX or HS type which do not affect the builder properties. According to the invention, zeolite mixtures such as these can be used with equal effect. NaX zeolite can also be used instead of NaA zeolite. From their production, the crystalline zeolites can also contain the X-ray amorphous preforms of similar composition in negligible quantities.

| Composition in % by weight | Example No. 1 | 2 | 3 | 4 |
|---|---|---|---|---|
| $C_{10-13}$—alkylbenzene sulfonate, Na—salt | 1.0 | 1.0 | 1.0 | 1.0 |
| Cetyl/oleyl alcohol + 8EO | 1.0 | 1.0 | 1.0 | 1.0 |
| Tallow fatty alcohol + 5EO | 4.5 | 4.5 | 4.5 | 4.5 |
| Tallow fatty alcohol + 14EO | 4.5 | 4.5 | 4.5 | 4.5 |
| Nonyl phenol + 9.5EO | — | — | — | — |
| Sodium aluminium silicate | 25.0 | 25.0 | 25.0 | 25.0 |
| Hydroxyethyl diphosphonic acid (HEDP) | 0.8 | 0.8 | 0.8 | 0.8 |
| Sodium carbonate | 20.0 | 20.0 | 20.0 | 20.0 |
| Sodium metasilicate, anhydrous | 28.0 | 28.0 | 28.0 | 28.0 |
| Carboxymethyl cellulose: methyl cellulose = 2.5:1 | 1.0 | 1.0 | 1.0 | 1.0 |
| Xanthan gum | — | 0.5 | 1.0 | 1.5 |
| Mg—silicate | 1.5 | 1.5 | 1.5 | 1.5 |
| Ethylene diamine tetracetic acid (EDTA), Na—salt | 0.25 | 0.25 | 0.25 | 0.25 |
| Optical brightener | 0.25 | 0.25 | 0.25 | 0.25 |
| Fragrance | 0.1 | 0.1 | 0.1 | 0.1 |
| Silicone defoamer | 0.1 | 0.1 | 0.1 | 0.1 |
| Sodium sulfate/water | remainder | remainder | remainder | remainder |
| Examination of the stock liquor | | | | |
| after 1 h | sediment, clear solution | sediment. cloudy solution | milky, homogeneous | milky, homogeneous |
| after 24 h | solid sediment, clear solution | sediment, cloudy solution | milky, homogeneous, low-viscosity | milky, homogeneous, medium viscosity |

| Composition in % by weight | Example No. 5 | 6 | 7 | 8 |
|---|---|---|---|---|
| $C_{10-13}$—alkylbenzene sulfonate, Na—salt | 1.0 | 1.0 | — | — |
| Cetyl/oleyl alcohol + 8EO | 1.0 | 1.0 | — | — |
| Tallow fatty alcohol + 5EO | 4.5 | 4.5 | — | — |
| Tallow fatty alcohol + 14EO | 4.5 | 4.5 | — | — |
| Nonyl phenol + 9.5EO | — | — | 6.0 | 12.0 |
| Sodium aluminium silicate | 25.0 | 25.0 | 25.0 | 25.0 |
| Hydroxyethyl diphosphonic acid (HEDP) | 0.8 | 0.8 | 0.8 | 0.8 |
| Sodium carbonate | 20.0 | 20.0 | 20.0 | 20.0 |
| Sodium metasilicate, anhydrous | 28.0 | 28.0 | 28.0 | 28.0 |
| Carboxymethyl cellulose:methyl cellulose = 2.5:1 | 1.0 | 1.0 | 1.0 | 1.0 |

-continued

| | | | | |
|---|---|---|---|---|
| Xanthan gum | 2.5 | 1.5 | 1.5 | 1.5 |
| Mg—silicate | 1.5 | 1.5 | 1.5 | 1.5 |
| Ethylene diamine tetracetic acid (EDTA), Na—salt | 0.25 | 0.25 | 0.25 | 0.25 |
| Optical brightener | 0.25 | — | — | — |
| Fragrance | 0.1 | — | — | — |
| Silicone defoamer | 0.1 | — | — | — |
| Sodium sulfate/water | remainder | remainder | remainder | remainder |
| Examination of stock liquor | | | | |
| after 1 h | milky, homogeneous | milky, homogeneous | milky, homogeneous | milky, homogeneous |
| after 24 h | milky, homogeneous, viscous | milky, homogeneous, medium viscosity | milky, homogeneous, medium viscosity | milky, homogeneous, medium viscosity |

| | Example No. | | | |
|---|---|---|---|---|
| Composition in % by weight | 9 | 10 | 11 | 12 |
| $C_{10-13}$—alkylbenzene sulfonate, Na—salt | — | — | 3.0 | 3.0 |
| Cetyl/oleyl alcohol + 8EO | 1.0 | 2.0 | 7.0 | 7.0 |
| Tallow fatty alcohol + 5EO | 4.5 | 6.5 | — | — |
| Tallow fatty alcohol + 14EO | 4.5 | 6.5 | — | — |
| Nonyl phenol + 9.5EO | — | — | — | — |
| Sodium aluminium silicate | 25.0 | 25.0 | 25.0 | 20.0 |
| Hydroxyethyl diphosphonic acid (HEDP) | 0.8 | 0.8 | 0.8 | 0.8 |
| Sodium carbonate | 20.0 | 20.0 | 20.0 | 20.0 |
| Sodium metasilicate, anhydrous | 28.0 | 28.0 | 28.0 | 28.0 |
| Carboxymethyl cellulose: methyl cellulose = 2.5:1 | 1.0 | 1.0 | 1.0 | 1.0 |
| Xanthan gum | 1.5 | 1.5 | 1.5 | 1.5 |
| Mg—silicate | 1.5 | 1.5 | 1.5 | 1.5 |
| Ethylene diamine tetracetic acid (EDTA), Na—salt | 0.25 | 0.25 | 0.25 | 0.25 |
| Optical brightener | — | — | — | — |
| Fragrance | — | — | — | — |
| Silicone defoamer | — | — | — | — |
| Sodium sulfate/water | remainder | remainder | remainder | remainder |
| Examination of stock liquor | | | | |
| after 1 h | milky, homogeneous | milky, homogeneous | milky, homogeneous | milky, homogeneous |
| after 24 h | milky, homogeneous, medium viscosity | milky, homogeneous, medium viscosity | milky, homogeneous, medium viscosity | milky, homogeneous, medium viscosity |

| | Example No. | | | |
|---|---|---|---|---|
| Composition in % by weight | 13 | 14 | 15 | 16 |
| $C_{10-13}$—alkylbenzene sulfonate, Na—salt | 3.0 | 3.0 | 3.0 | 3.0 |
| Cetyl/oleyl alcohol + 8EO | 7.0 | 7.0 | 7.0 | 7.0 |
| Tallow fatty alcohol + 5EO | — | — | — | — |
| Tallow fatty alcohol + 14EO | — | — | — | — |
| Nonyl phenol + 9.5EO | — | — | — | — |
| Sodium aluminium silicate | 30.0 | 40.0 | 15.0 | 15.0 |
| Hydroxyethyl diphosphonic acid (HEDP) | 0.8 | 0.8 | 0.8 | 0.8 |
| Sodium carbonate | 10.0 | 5.0 | 25.0 | 25.0 |
| Sodium metasilicate, anhydrous | 28.0 | 28.0 | 33.0 | 33.0 |
| Carboxymethyl cellulose: methyl cellulose = 2.5:1 | 1.0 | 1.0 | 1.0 | 1.0 |
| Xanthan gum | 1.5 | 2.0 | 1.0 | 1.0 |
| Mg—silicate | 1.5 | 1.5 | 1.5 | 1.5 |
| Ethylene diamine tetracetic acid (EDTA), Na—salt | 0.25 | 0.25 | 0.25 | 0.25 |
| Optical brightener | — | — | — | — |
| Fragrance | — | — | — | — |
| Silicone defoamer | — | — | — | — |
| Sodium sulfate/water | remainder | remainder | remainder | remainder |
| Examination of stock liquor | | | | |
| after 1 h | mikly, homogeneous | milky, homogeneous | milky, homogeneous | milky, homogeneous |
| after 24 h | milky, homogeneous, medium viscosity | milky, homogeneous, medium viscosity | milky, homogeneous, medium viscosity | milky, homogeneous |

Comparison Examples to Example 1 with (a) sodium polyacrylate (Pigmentverteiler N, a product of BASF) and (b) purified sodium carboxymethyl cellulose (Relatin 7000 P, a product of Henkel KGaA):

| Composition in % by weight | Comparison Example No. a | Comparison Example No. b |
|---|---|---|
| $C_{10-13}$—alkylbnezene sulfonate, Na—salt | 1.0 | 1.0 |
| Cetyl/oleyl alcohol + 8EO | 1.0 | 1.0 |
| Tallow fatty alcohol + 5EO | 4.5 | 4.5 |
| Tallow fatty alcohol + 14EO | 4.5 | 4.5 |
| Nonyl phenol + 9.5EO | — | — |
| Sodium aluminium silicate | 25.0 | 25.0 |
| Hydroxyethyl diphosphonic acid (HEDP) | 0.8 | 0.8 |
| Sodium carbonate | 20.0 | 20.0 |
| Sodium metasilicate, anhydrous | 28.0 | 28.0 |
| Carboxymethyl cellulose: methyl cellulose = 2.5:1 | 1.0 | 1.0 |
| Sodium polyacrylate | 2.5 | — |
| Sodium carboxymethyl cellulose | — | 2.5 |
| Mg—silicate | 1.5 | 1.5 |
| Ethylene diamine tetracetic acid (EDTA) Na—salt | 0.25 | 0.25 |
| Optical brightener | 0.25 | 0.25 |
| Fragrance | 0.1 | 0.1 |
| Silicone defoamer | 0.1 | 0.1 |
| Sodium sulfate/water | remainder | remainder |
| Examination of the stock liquor | | |
| after 1 h | sediment, above: clear solution | sediment, above: creaming |
| after 24 h | no longer determinable | no longer determinable |

What is claimed is:

1. A powdered composition consisting essentially of an, alkaline reacting washing and cleaning product, capable of being made up into a stable aqueous stock liquor suspension containing from about 5% to about 15% by weight of said composition, said powdered composition consisting essentially of (a) from about 10 to about 40% by weight, in finely particulate form, of an NaA type zeolite, an NaX type zeolite, or a mixture of such zeolites;

(b) from about 0.2 to about 2.5% by weight of xanthan gum;

(c) from about 2 to about 40% by weight of an anionic surfactant, a non-ionic surfactant, or a mixture of such surfactants;

(d) from 0 to about 60% by weight of at least one component selected from the group consisting of a water-soluble organic complexing agent, a water-soluble inorganic complexing agent, an alkali metal carbonate, an alkali metal silicate, and an alkali metal sulfate; and (e) balance to 100% by weight of water in addition to any water adsorbed by said zeolite, provided that the total water content of said composition does not exceed about 20% by weight;

and wherein the ratio of weight of (a) to (b) is between about 5:1 and about 25:1.

2. A composition in accordance with claim 1 wherein from about 15 to about 25% by weight of component (a) is present in the composition.

3. A composition in accordance with claim 1 wherein from about 0.5 to about 2.0% by weight of component (c) is present in the composition.

4. A composition in accordance with claim 1 wherein component (c) is present in from about 5 to about 15% by weight.

5. A composition in accordance with claim 1 wherein from about 0.5 to about 50% by weight of component (d) is present in the composition.

6. A composition in accordance with claim 1 wherein the ratio by weight of (a) to (b) is between about 10:1 and about 20:1.

7. A suspension consisting essentially of an aqueous stable stock liquor for washing and cleaning containing from about 5 to about 15% by weight of a powder-form composition suspended therein an consisting essentially of (a) from about 10 to about 40% by weight, in finely particulate form, of an NaA type zeolite, an NaX type zeolite, or a mixture of such zeolites;

(b) from about 0.2 to about 2.5% by weight of xanthan gum;

(c) from about 2 to about 40% by weight of an anionic surfactant, a non-ionic surfactant, or a mixture of such surfactants;

(d) from 0 to about 60% by weight of at least one component selected from the group consisting of a water-soluble organic complexing agent, a water-soluble inorganic complexing agent, an alkali metal carbonate, an alkali metal silicate, and an alkali metal sulfate; and (e) balance to 100% by weight of water in addition to any water adsorbed by said zeolite, provided that the total water content of said composition does not exceed about 20% by weight;

and wherein the ratio by weight of (a) to (b) is between about 5:1 and about 25:1.

8. An aqueous suspension in accordance with claim 7 wherein from about 15 to about 25% by weight of component (a) in said powder-form composition is present in the suspension.

9. An aqueous suspension in accordance with claim 7 wherein from about 0.5 to about 2.0% by weight of component (b) in said powder-form composition is present in the suspension.

10. An aqueous suspension in accordance with claim 7 wherein component (c) in said powder-form composition is present in from about 5 to about 15% by weight.

11. An aqueous suspension in accordance with claim 7 wherein from about 0.5 to about 50% by weight of component (d) in said powder-form composition is present in the suspension.

12. An aqueous suspension in accordance with claim 7 wherein the ratio by weight of (a) to (b) in said powder-form composition is between about 10:1 and about 20:1.

13. An aqueous suspension in accordance with claim 7 wherein said suspension contains about 10% by weight of the powder-form composition.

14. In a dry powder-form washing and cleaning agent containing (a) from about 10 to about 40% by weight of a finely particulate form of an NaA type zeolite, an NaX type zeolite, or a mixture of such zeolites; and which is to be made up into approximately 5 to 15% by weight aqueous stable stock liquor suspensions; the improvement comprising including in said agent a dispersion aid (b) consisting essentially of about 0.2 to 2.5% by weight of xanthan gum, the weight ratio of (a):(b) being about 5–25:1.

15. The improvement of claim 14 wherein (a) is present in from about 15 to about 25% by weight.

16. The improvement of claim 14 wherein said dispersing aid (b) is present in from about 0.5 to about 2.0% by weight.

17. The improvement of claim 15 wherein said dispersing aid (b) is present in from about 0.5 to about 2.0% by weight.

18. The improvement of claim 14 wherein said ratio (a):(b) is about 10–20:1.

19. The improvement of claim 16 wherein said ratio (a):(b) is about 10–20:1.

20. The improvement of claim 17 wherein said ratio (a):(b) is about 10–20:1.

* * * * *